US012768258B2

(12) United States Patent
McIntyre et al.

(10) Patent No.: US 12,768,258 B2
(45) Date of Patent: Oct. 20, 2026

(54) CONTROLLING A DRILLING OPERATION BY ADJUSTING A RATE OF PENETRATION SETPOINT

(71) Applicant: Pason Systems Corp., Calgary (CA)

(72) Inventors: Jonathan McIntyre, Calgary (CA); Sean Scotvold, Calgary (CA); Aaron Eddy, Calgary (CA)

(73) Assignee: Pason Systems Corp., Calgary (CA)

( * ) Notice: Subject to any disclaimer, the term of this patent is extended or adjusted under 35 U.S.C. 154(b) by 4 days.

(21) Appl. No.: 18/617,247

(22) Filed: Mar. 26, 2024

(65) Prior Publication Data

US 2025/0264014 A1 Aug. 21, 2025

(30) Foreign Application Priority Data

Feb. 20, 2024 (CA) ..... CA 3229620

(51) Int. Cl.
*E21B 44/00* (2006.01)
*E21B 45/00* (2006.01)

(52) U.S. Cl.
CPC ..... *E21B 44/00* (2013.01); *E21B 45/00* (2013.01)

(58) Field of Classification Search
CPC ..... E21B 44/00; E21B 45/00
See application file for complete search history.

(56) References Cited

U.S. PATENT DOCUMENTS

| | | | | |
|---|---|---|---|---|
| 10,989,038 | B1 * | 4/2021 | Shen | E21B 44/06 |
| 2005/0133259 | A1 * | 6/2005 | Koederitz | E21B 44/00 175/27 |
| 2013/0105221 | A1 * | 5/2013 | Wassell | E21B 44/04 175/40 |
| 2021/0115779 | A1 * | 4/2021 | Hopwood | E21B 21/08 |
| 2022/0106865 | A1 * | 4/2022 | Neufeldt | E21B 44/04 |
| 2024/0287889 | A1 * | 8/2024 | Agarwal | E21B 47/09 |

FOREIGN PATENT DOCUMENTS

WO WO-2021097414 A1 * 5/2021

OTHER PUBLICATIONS

"Class Percentile," webpage < https://commons.apache.org/proper/commons-math/javadocs/api-3.6.1/org/apache/commons/math3/stat/descriptive/rank/Percentile.html >, 11 pages, retrieved Jan. 25, 2024.

* cited by examiner

*Primary Examiner* — Matthew R Buck
(74) *Attorney, Agent, or Firm* — D'Ambrosio & Menon, PLLC; Usha Menon

(57) ABSTRACT

A method of controlling a drilling operation includes receiving rate-of-penetration (ROP) data. The ROP data is indicative of a rate-of-penetration of a drill bit being operated during the drilling operation. Based on the ROP data, an ROP variability condition is determined to have been met. This includes determining that a variability of the rate-of-penetration has exceeded a threshold. A peak-shaving operation is then activated, which includes adjusting, based on the ROP data, an ROP setpoint. The drilling operation is then controlled according to the adjusted ROP setpoint.

28 Claims, 10 Drawing Sheets

CONTROLLING A DRILLING OPERATION BY ADJUSTING A RATE OF PENETRATION SETPOINT

CROSS-REFERENCE TO RELATED APPLICATIONS

This application is related to and claims priority to Canadian Patent Application No.: 3,229,620 filed on Feb. 20, 2024, the contents of which are incorporated by reference herein.

TECHNICAL FIELD

The present disclosure relates to automated wellbore drilling and in particular to methods, systems, and computer-readable media for controlling a drilling operation by adjusting a rate of penetration setpoint.

BACKGROUND

Oil and gas wellbore drilling may be partially or entirely automated. For example, certain example automated drilling units (or "AutoDrillers") may attempt to control the rate of penetration (ROP), weight on bit (WOB), differential pressure, and torque to their desired setpoints by regulating the drawworks. Examples of such drilling parameters may comprise any one or more of readings from hookload, depth, and drilling fluid pressure sensors. Additional automation includes control systems that are designed to adjust the AutoDriller setpoints during the drilling process to increase drilling efficiency by, for example, extending drill bit life and reducing total drilling hours.

During the drilling process, it can be challenging to mitigate situations causing premature bit damage. Rapid changes in the indentation of the drill bit cutters into the rock formations can lead to premature wear of the bit. This is influenced by parameters such as ROP and WOB, as well as the geological formations through which drilling is proceeding. Sudden changes in the geology can load the drill bit face unevenly, resulting in damage due to high impacts focused on only a few of the drill bit cutters.

SUMMARY

According to a first aspect of the disclosure, there is provided a method of controlling a drilling operation, comprising: receiving rate-of-penetration (ROP) data, wherein the ROP data is indicative of a ROP of a drill bit being operated during the drilling operation; determining, based on the ROP data, that an ROP variability condition has been met, including determining that a variability of the ROP has exceeded a threshold; based on the determination that the ROP variability condition has been met, activating a peak-shaving operation comprising adjusting, based on the ROP data, an ROP setpoint; and controlling the drilling operation according to the adjusted ROP setpoint.

Determining that the variability of the ROP has exceeded the threshold may comprise: windowing the ROP data by applying a temporal window to the ROP data; and determining, based on the windowed ROP data, that the variability of the ROP during the temporal window has exceeded the threshold.

Determining that the variability of the ROP has exceeded the threshold may comprise: determining, based on the ROP data, a coefficient of variation of the ROP, wherein the coefficient of variation is a standard deviation of ROP readings comprised in the ROP data divided by an average of the ROP readings; and determining that the coefficient of variation has exceeded the threshold.

Adjusting the ROP setpoint may comprise: windowing the ROP data by applying a temporal window to the ROP data; and adjusting the ROP setpoint based on the windowed ROP data.

Adjusting the ROP setpoint may comprise: determining, based on the ROP data, a percentile of the ROP data; and adjusting the ROP setpoint by a sum of the percentile and an offset value.

The method may further comprise: receiving weight-on-bit (WOB) data, wherein the WOB data is indicative of a weight acting on the drill bit during the drilling operation; determining, based on the WOB data, that a preset condition has been met; and based on the determination that the preset condition has been met: deactivating the peak-shaving operation; and increasing the ROP setpoint.

Determining that the preset condition has been met may comprise: determining, based the WOB data, a proportional difference between the WOB setpoint and the WOB; determining that the proportional difference between the WOB setpoint and the WOB is greater than a first threshold; determining, based on the ROP data, a proportional difference between the ROP setpoint and the ROP; determining that the proportional difference between the ROP setpoint and the ROP is less than a second threshold, wherein the first threshold is greater than the second threshold; and based on the determination that the proportional difference between the WOB setpoint and the WOB is greater than the first threshold, and based on the determination that the proportional difference between the ROP setpoint and the ROP is less than the second threshold, determining that the preset condition has been met.

Increasing the ROP setpoint may comprise linearly increasing the ROP setpoint.

Increasing the ROP setpoint may comprise: determining, based on the ROP data, a proximity of the ROP to the ROP setpoint; and increasing the ROP setpoint until the proximity of the ROP to the ROP setpoint is less than a proximity threshold.

The method may further comprise, once the proximity of the ROP to the ROP setpoint is less than the proximity threshold, re-activating the peak-shaving operation.

The method may further comprise monitoring a depth of the drill bit. The peak-shaving operation may further comprise adjusting the ROP setpoint based on the monitored depth.

The method may further comprise determining a maximum ROP setpoint. During the drilling operation, the ROP setpoint may be prevented from being increased above the maximum ROP setpoint.

The method may further comprise: determining that the ROP setpoint is greater than the maximum ROP setpoint; and before preventing the ROP setpoint from being increased above the maximum ROP setpoint, setting the ROP setpoint equal to the maximum ROP setpoint.

Determining the maximum ROP setpoint may comprise: receiving a maximum depth of cut (DOC) value; and determining, based on the maximum DOC value, the maximum ROP setpoint.

Determining the maximum ROP setpoint may comprise: determining a revolutions-per-minute (RPM) value, wherein the RPM value is indicative of a rotational speed of the drill bit; multiplying the RPM value by the maximum DOC value; and determining the maximum ROP setpoint based on the multiplication.

The method may further comprise: monitoring a depth of the drill bit; and receiving the maximum DOC value comprises receiving the maximum DOC value based on the monitored depth.

According to a further aspect of the disclosure, there is provided a method of controlling a drilling operation, comprising: receiving a maximum depth of cut (DOC) value; determining, based on the maximum DOC value, a first recommended ROP setpoint; selecting, from among one or more recommended ROP setpoints, including the first recommended ROP setpoint, one of the one or more recommended ROP setpoints; and controlling the drilling operation according to the selected recommended ROP setpoint.

Determining the first recommended ROP setpoint may comprise: receiving a revolutions-per-minute (RPM) value, wherein the RPM value is indicative of a rotational speed of a drill bit being operated during the drilling operation; multiplying the RPM value by the maximum DOC value; and determining the first recommended ROP setpoint based on the multiplication.

Selecting one of the one or more recommended ROP setpoints may comprise selecting, from among the one or more recommended ROP setpoints, the minimum ROP setpoint recommendation.

Selecting one of the one or more recommended ROP setpoints may comprise: generating one or more additional ROP setpoint recommendations; and selecting, from among the first recommended ROP setpoint and the one or more additional ROP setpoint recommendations, one of the ROP setpoint recommendations.

Generating the one or more additional ROP setpoint recommendations may comprise generating an additional ROP setpoint recommendation from a peak shaving operation comprising: receiving rate-of-penetration (ROP) data, wherein the ROP data is indicative of a ROP of a drill bit being operated during the drilling operation; and determining, based on the ROP data, that an ROP variability condition has been met, including determining that a variability of the ROP has exceeded a threshold; and based on the determination that the ROP variability condition has been met, generating, based on the ROP data, the additional ROP setpoint recommendation.

The method may further comprise monitoring a depth of a drill bit being operated during the drilling operation. Receiving the maximum DOC value may comprise receiving the maximum DOC value based on the monitored depth.

According to a further aspect of the disclosure, there is provided a system for controlling a drilling operation, the system comprising: a height control apparatus configured to adjust a height of a drill string comprising a drill bit used during the drilling operation; a rotational drive unit comprising a rotational drive unit controller configured to control rotation of the drill bit; and a drilling controller communicatively coupled to the height control apparatus and the rotational drive unit controller, and being configured to perform any of the above-described methods.

According to a further aspect of the disclosure, there is provided a non-transitory computer-readable medium having stored thereon program code executable by a processor and configured, when executed, to cause the processor to perform any of the above-described methods.

This summary does not necessarily describe the entire scope of all aspects. Other aspects, features, and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

Figure 1:
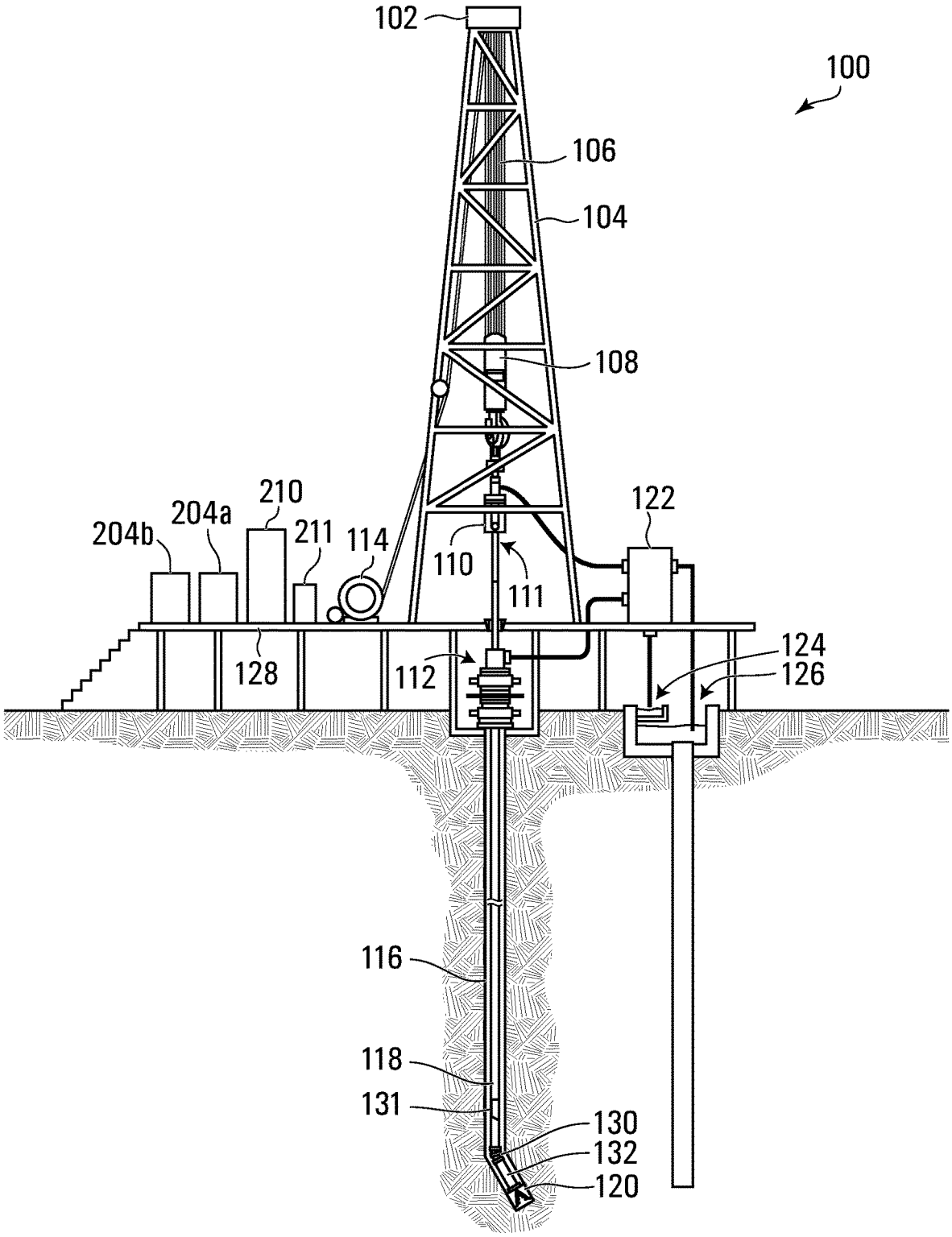
FIG. 1 is a schematic diagram of a drilling rig, according to an embodiment of the disclosure.

The present disclosure seeks to provide methods, systems, and computer-readable media for controlling a drilling operation by adjusting a rate of penetration setpoint. While various embodiments of the disclosure are described below, the disclosure is not limited to these embodiments, and variations of these embodiments may well fall within the scope of the disclosure which is to be limited only by the appended claims.

As described above, sudden changes in the geology through which drilling is proceeding can load the drill bit face unevenly, resulting in damage or premature wear to the drill bit. Highly variable ROP measurements may be indicative of such scenarios. A driller may therefore decide to input a lower than typical ROP setpoint to the AutoDriller during such intervals, to prevent the onset of bit damage. Providing a control system for automating ROP setpoint adjustments in response to varying ROP and other sensor measurements may extend the drill bit life and provide greater stability in the drilling dynamics.

Generally, according to embodiments of the disclosure, there is described a method of controlling a drilling operation. The method includes receiving rate of penetration (ROP) data. For example, a sliding or rolling window of past ROP readings may be received. The ROP data is indicative of an ROP of a drill bit being operated during the drilling operation. Based on the ROP data, a determination is made as to whether an ROP variability condition has been met. As part of this determination, a variability of the ROP is compared to a threshold. For example, according to some embodiments, based on the ROP data, a coefficient of variation of the ROP is determined. The coefficient of variation is a standard deviation of ROP readings comprised in the ROP data divided by a mean of the ROP readings. The coefficient of variation is then compared to a preset threshold. If the coefficient of variation is determined to have exceeded the threshold, then the ROP variability condition is determined to have been met.

In response to determining that the ROP variability condition has been met, a peak shaving operation is activated. As part of the peak shaving operation, an ROP setpoint is adjusted based on the ROP data. For example, according to some embodiments, a preset percentile of ROP readings in a sliding or rolling window of past ROP readings is determined. The ROP setpoint is then adjusted based on this percentile plus a preset offset amount. The drilling operation is then controlled based on the adjusted ROP setpoint. The ROP setpoint may be adjusted at a certain frequency, for example every second, taking into account any new ROP data that has since been received.

According to some embodiments, the percentile set by the user may be different for different drill depths. Therefore, as drilling progresses, adjustments to the ROP setpoint may accordingly change in response to new percentiles being used in the calculation of the ROP setpoint adjustments.

In addition to activating the peak shaving operation in response to excess variability in the ROP readings, the ROP setpoint may be prevented from increasing above a certain maximum threshold. Such a threshold may be calculated on the basis of a maximum depth of cut (DOC) set by a user and controlled by a so-called DOC controller (DOC is the rate of penetration per revolution of the drill bit, or in other words the depth to which the drill bit cutter penetrates the formation per revolution of the drill bit). Limiting the DOC from large values may help prevent wear on the drill bit, extending the life of the drill bit.

According to some embodiments, at any time that the ROP setpoint generated by the peak shaving operation is determined to be greater than the ROP setpoint generated by the DOC controller, then the ROP setpoint that is used by the AutoDriller to control the drilling operation is the lower of the two ROP setpoints, i.e. it is the ROP setpoint generated by the DOC controller. Future ROP setpoint adjustments will then continue to be limited by the lower of these two ROP setpoint "recommendations". According to some embodiments, the ROP setpoint recommendation is determined by multiplying a revolutions-per-minute (RPM) value by the maximum DOC value, wherein the RPM value is indicative of a rotational speed of the drill bit.

According to some embodiments, the maximum DOC value set by the user may be different for different drill depths. Therefore, as drilling progresses, the ROP setpoint recommendation may accordingly change in response to new maximum DOC values being used in the calculation of the ROP setpoint recommendation.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change WOB during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Figure 2A:
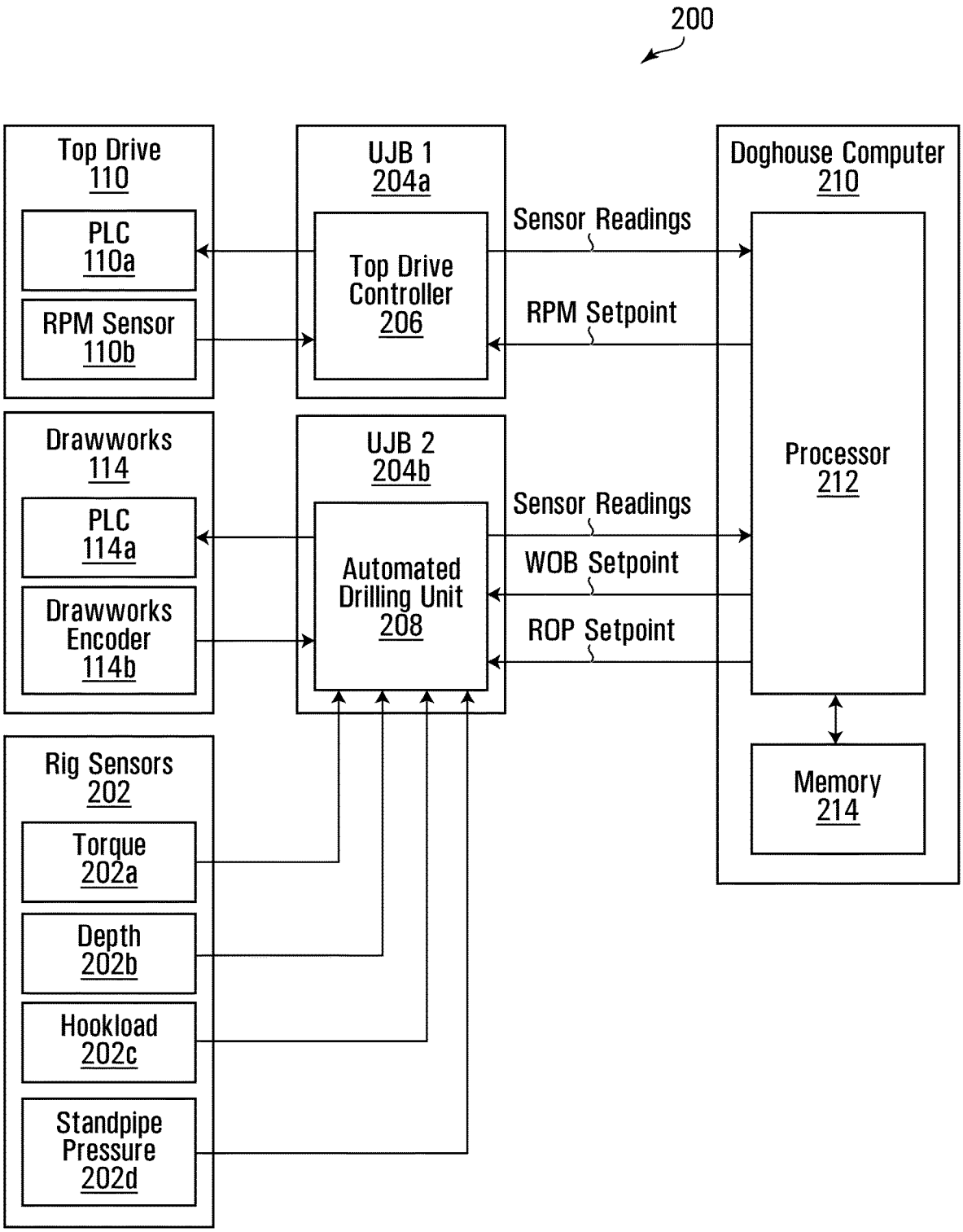
FIGS. 2A and 2B are block diagrams of systems for performing automated drilling of a wellbore, according to the embodiment of FIG. 1.

FIG. 2A shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206, which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208, which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*, 204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the ROP of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores on it computer program code that is executable by the processor 212 and that, when executed, causes the processor 212 to perform a method 500 for performing automated drilling of the wellbore 116, such as that depicted in FIG. 5. The processor 212 receives readings from the RPM sensor 110*b*, drawworks encoder 114*b*, and the rig sensors 202, and sends an ROP target or "setpoint" to automated drilling unit 208. According to some embodiments (not discussed in further detail herein), processor 212 additionally sends an RPM setpoint to top drive controller 206 and a WOB setpoint to automated drilling unit 208. The top drive controller 206 and automated drilling unit 208 relay these setpoints to the top drive PLC 110*a* and drawworks PLC 114*a*, respectively, where they are used for automated drilling. More generally, the RPM setpoint is an example of a rotation rate setpoint.

Each of the first and second junction boxes may comprise a Pason Universal Junction Box™ (UJB) manufactured by Pason Systems Corp. of Calgary, Alberta. The automated drilling unit 208 may be a Pason AutoDriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2A, the top drive controller 110 and the automated drilling unit 208 are distinct and respectively use the RPM setpoint and WOB setpoint for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM setpoint, only the WOB setpoint, one or both of the RPM and WOB setpoints in combination with additional drilling parameters, or setpoints based on drilling parameters other than RPM and WOB. Examples of these additional drilling parameters comprise differential pressure, an ROP setpoint, depth of cut, torque, and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 2B:
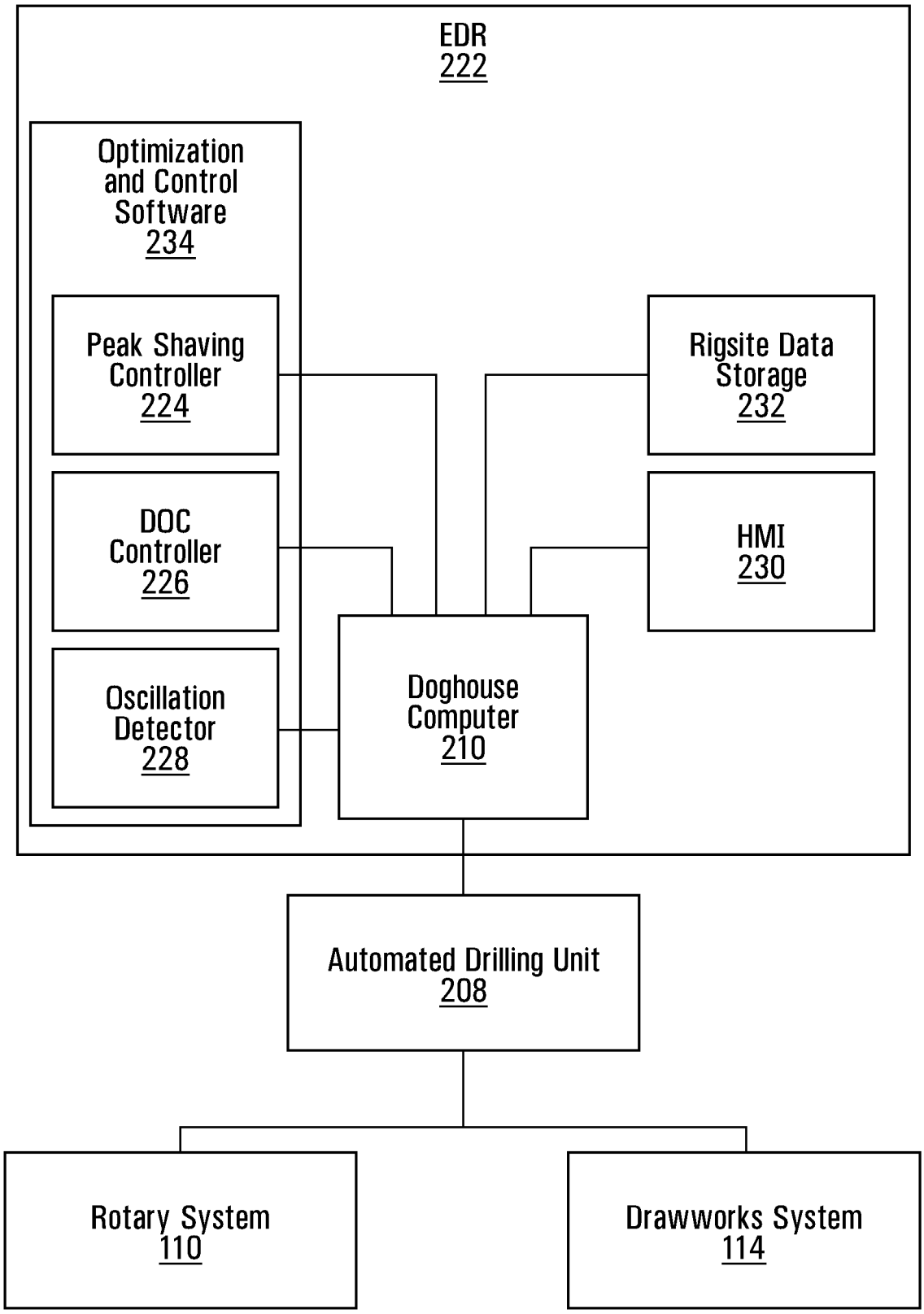

Turning to FIG. 2B, there is shown a block diagram of a system 220 for controlling adjustments to an ROP setpoint. System 220 includes an Electronic Drilling Recorder (EDR) 222 comprising a peak shaving controller 224 for providing ROP setpoint recommendations to automated drilling unit 208, a DOC controller 226 for maximally limiting recommended adjustments to the ROP setpoint as output by peak shaving controller 224, an oscillation detector 228 for performing differential pressure oscillation detection, a Human Machine Interface (HMI) 230, rigsite data storage 232, and doghouse computer 210. Optimization and control software 234 includes peak shaving controller 224, DOC controller 226, and oscillation detector 228. DOC controller 226 may additionally maximally limit ROP setpoint recommendations that are output from other components designed to generate ROP setpoint recommendations, such as other components that are part of optimization and control software 234.

According to some embodiments, DOC controller 226 may also provide ROP setpoint recommendations to automated drilling unit 208, in addition to maximally limiting recommended adjustments to the ROP setpoint as output by peak shaving controller 224.

Doghouse computer 210 collects sensor readings from UJB 204*b* (FIG. 2A). The sensor readings (which may be referred to as drilling parameters) include ROP, RPM, WOB, differential pressure, torque, travelling block height (or simply "block height"), and depth, and may be derived directly from the measurements obtained by the sensors. Other drilling parameters may be derived from RPM, WOB, differential pressure, and torque. For example, bit torque may be derived from differential pressure times the ratio of a maximum torque of mud motor 132 to a maximum differential pressure of mud motor 132. Doghouse computer 210 processes the sensor readings into a stream of sensor data, and peak shaving controller 224 and DOC controller 226 are configured to receive the sensor data from doghouse computer 210. Based on the sensor data, peak shaving controller 224, in tandem with DOC controller 226, may adjust an ROP setpoint, as described in further detail below. Each of peak shaving controller 224 and DOC controller 226 may operate in parallel, tandem, or independently of each other, in addition to other functions such as optimization processes and routines that handle other aspects of the drilling process, such as managing stick slip.

Adjusted drilling parameter setpoints (and in particular an ROP setpoint) are communicated to doghouse computer 210 and are sent from doghouse computer 210 to automated drilling unit 208. Automated drilling unit 208 may then control the drilling operation based on the updated drilling parameter setpoints, by controlling a rotary system (e.g., top drive 110) and a drawworks system (e.g., drawworks 114).

Figure 3:
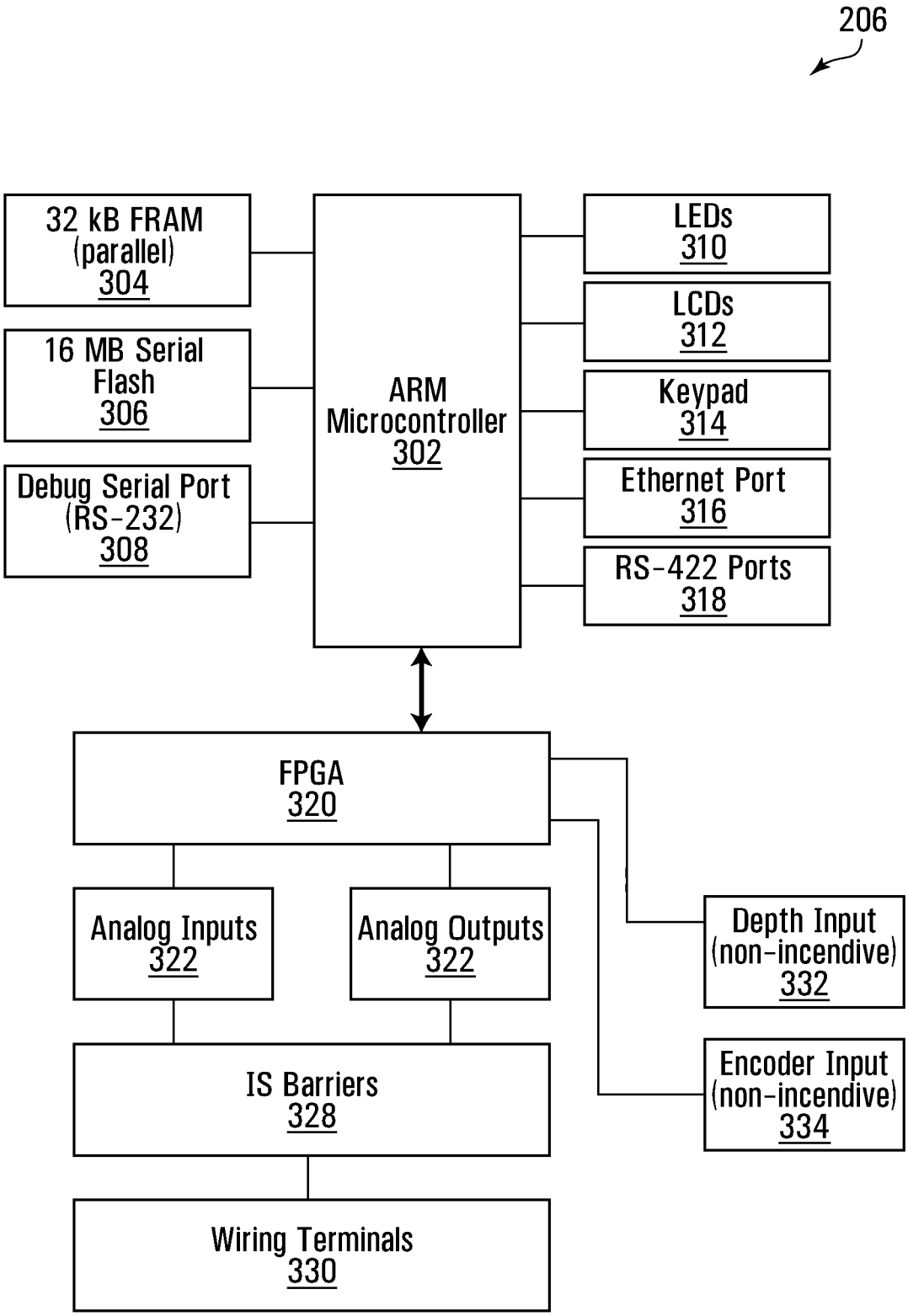
FIG. 3 depicts a block diagram of the automated drilling unit of FIG. 1, according to an embodiment of the disclosure.

Referring now to FIG. 3, there is shown a hardware block diagram 300 of the second junction box 204*b* of FIG. 2A. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automated drilling unit 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automated drilling unit 208 outputs a throttle signal to a PLC using an analog output.

According to some embodiments, automated drilling unit 208 communicates with a band brake controller using an RS-422 port.

The FPGA 320 is also communicatively coupled to a non-incendive depth input 332 and a non-incendive encoder input 334. In different embodiments (not depicted), the automated drilling unit 208 may receive different sensor readings in addition to or as an alternative to the readings obtained using the depicted sensors 202*a*, 202*b*, 202*c*, 202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
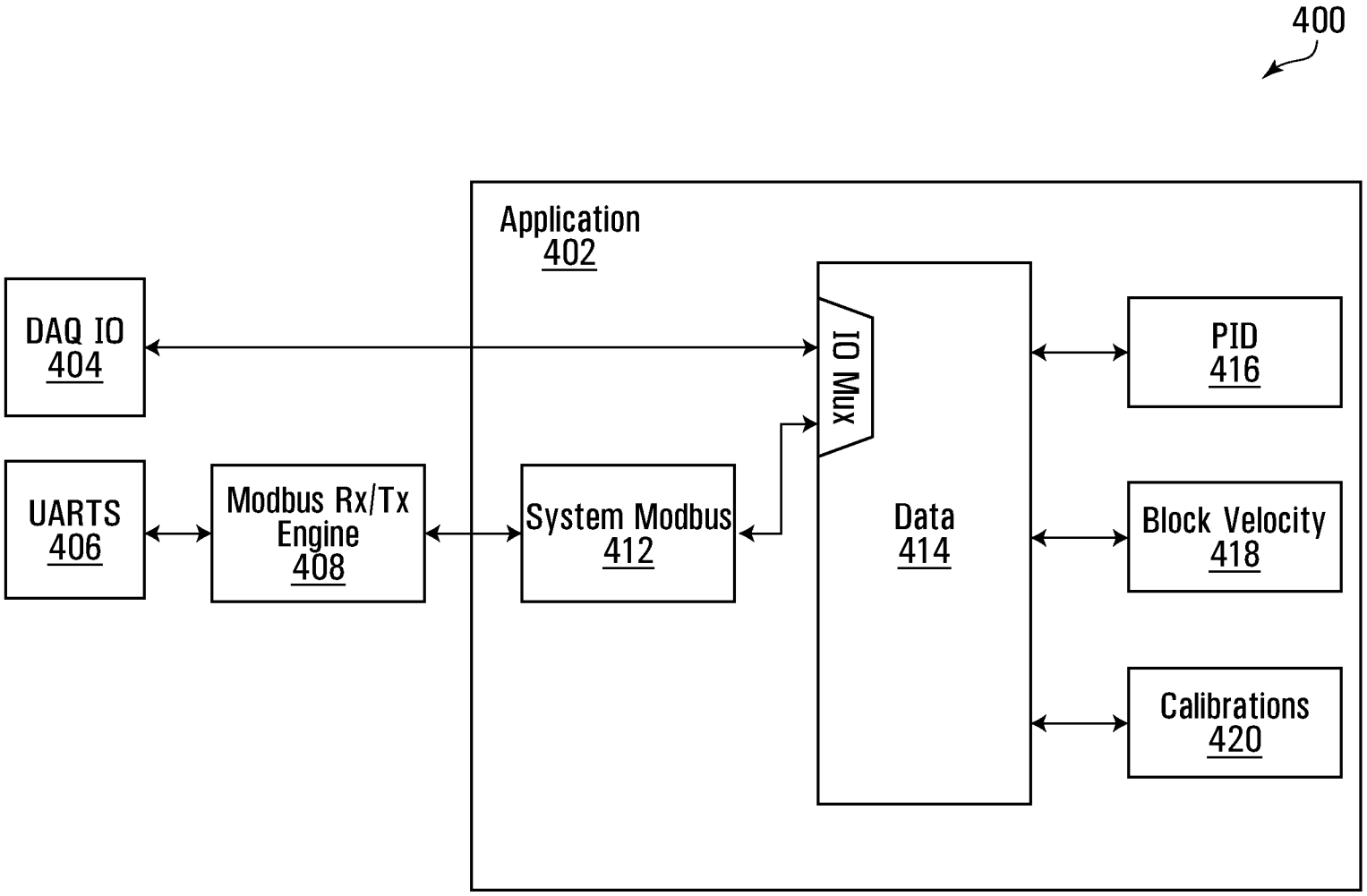
FIG. 4 depicts a block diagram of software modules running on the automated drilling unit of FIG. 1, according to an embodiment of the disclosure.

Referring now to FIG. 4, there is shown a block diagram of software modules, some of which comprise a software application 402, running on the automated drilling unit of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the traveling block 108 from the traveling block height derived using measurements from the block height sensor. The microcontroller 302 uses the calibrations module 420 to convert the electrical signals received from the sensors 202*a*, 202*b*, 202*c*, 202*d* into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

Figure 5:
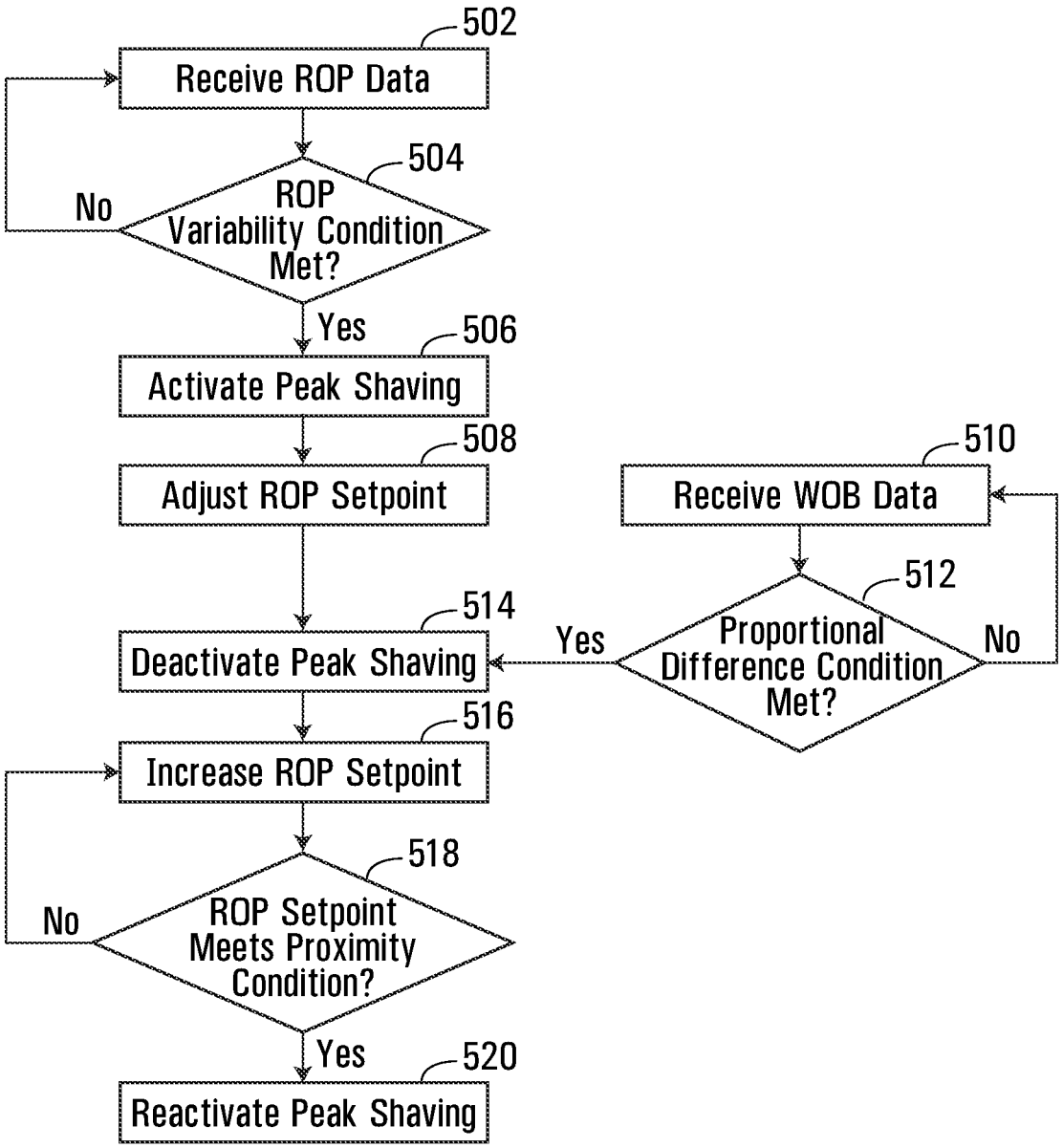
FIG. 5 depicts a flow diagram of a method of controlling a drilling operation by adjusting a rate of penetration setpoint using a peak shaving operation, according to an embodiment of the disclosure.

Turning now to FIG. 5, there is shown a flow diagram of a method of controlling a drilling operation by adjusting a rate of penetration setpoint using a peak shaving operation, according to an embodiment of the disclosure.

At block 502, during a rotary drilling operation, ROP data is received at peak shaving controller 224. The ROP data may be pre-processed and may comprise, for example, a sequence of ROP readings obtained from a depth-tracking sensor, an example of which is described in further detail below. Alternatively, peak shaving controller 224 processes the raw ROP data to extract ROP readings therefrom. Peak shaving controller 224 applies a sliding or rolling window to the ROP readings, and, in the processing described below, considers only the ROP readings comprised in the window. According to some embodiments, the window may comprise the past 2 minutes of ROP readings.

At block 504, peak shaving controller 224 determines whether an ROP variability condition has been met. In general, peak shaving controller 224 determines whether, based on the window of ROP readings, a variability of the ROP readings is greater than a certain threshold. According to some embodiments, peak shaving controller 224 determines, based on the windowed ROP readings, a coefficient of variation of the ROP readings. The coefficient of variation is a standard deviation of the ROP readings divided by an average, such as the mean, of the ROP readings. The coefficient of variation is then compared to a preset threshold, and if the coefficient of variation is determined to have exceeded the threshold then peak shaving controller 224 may determine that the ROP variability condition has been met. Otherwise, the process returns to block 502.

If peak shaving controller 224 determines that the coefficient of variation has exceeded the threshold, then at block 506 a peak shaving operation is activated.

At block 508, in response to activating the peak shaving operation, peak shaving controller 224 generates ROP setpoint recommendations that are passed to automated drilling unit 208. An ROP setpoint recommendation (or simply, an "ROP setpoint") is calculated based on the sliding window of past ROP readings. In particular, according to some embodiments, peak shaving controller 224 determines a preset percentile (for example, the $90^{th}$ percentile) of the ROP readings contained in the window, and adjusts the current ROP setpoint based on this percentile and a small offset value. According to some embodiments, the offset may be 2 m/hr by default, which is generally negligible in highly-variable conditions. The offset may assist in keeping the ROP setpoint above the measured ROP readings if the ROP is steady at a near-constant value.

According to some embodiments, the following sequence may be used to calculate the percentile:

1. Let n be the length of the (sorted) array and $0<p<=100$ be the desired percentile.
2. If n=1 return the unique array element (regardless of the value of p); otherwise:
3. Compute the estimated percentile position pos=p*(n+1)/100 and the difference, d, between pos and floor(pos) (i.e. the fractional part of pos).
4. If pos<1 return the smallest element in the array.
5. Else if pos>=n return the largest element in the array.
6. Else let lower be the element in position floor(pos) in the array and let upper be the next element in the array. Return lower+d*(upper−lower).

According to some embodiments, other methods adjusting the ROP setpoint based on the window of ROP data may be used. For example, a low-pass filtering algorithm (such as a moving average) may be used.

According to some embodiments, the percentile that is used to control adjustment of the ROP setpoint may be variable as a function of depth. For example, a user may set different percentiles for different drill depths. As drilling progresses, the percentile that is used in the calculation of the ROP setpoint adjustments may correspondingly change.

Reducing the ROP setpoint can indirectly cause the WOB to decrease. Low WOB can decrease the overall ROP. Therefore, if the peak shaving operation is causing the AutoDriller to limit ROP to a point at which WOB falls significantly below its setpoint, it is desirable to raise the ROP setpoint, leading to increased instantaneous ROP which in turn leads to increased WOB. Peak shaving controller 224 therefore further includes a WOB monitoring component, as now described.

As the ROP setpoint is adjusted (block 508), peak shaving controller 224 further monitors incoming WOB readings received at hookload sensor 202*c* and that are passed to peak shaving controller 224. As with ROP data, the WOB data may be pre-processed and may comprise, for example, a sequence of WOB readings obtained from hookload sensor 202*c*. Alternatively, peak shaving controller 224 processes the raw WOB data to extract WOB readings therefrom. Peak shaving controller 224 applies a sliding or rolling window to the WOB readings, and, in the processing described below, considers only the WOB readings comprised in the window. According to some embodiments, the window may comprise the past 2 minutes of WOB readings.

At block 512, peak shaving controller 224 determines whether a proportional difference condition has been met. According to some embodiments, the proportional difference condition is met if there is greater proportional difference between the WOB setpoint and the WOB readings than the proportional difference between the ROP setpoint and the ROP readings. The proportional difference between a setpoint and its measured value may be defined as [(setpoint−measured)/setpoint].

More particularly, according to some embodiments, peak shaving controller 224 determines, based the WOB readings, whether the proportional difference between the WOB setpoint and the WOB readings is greater than a first threshold. Peak shaving controller 224 further determines, based on the ROP readings, whether the proportional difference between the ROP setpoint and the ROP readings is less than a second threshold. The first threshold is greater than the second threshold.

If the proportional difference condition is determined to have been met, then, at block 514, the peak shaving operation is de-activated, and the ROP setpoint is increased. For example, the ROP setpoint may be increased linearly.

At block 518, peak shaving controller 224 determines whether the ROP is no longer near the ROP setpoint. In particular, according to some embodiments, peak shaving controller 224 determines, based on the ROP readings, the proportional difference between the ROP setpoint and the ROP readings. If the proportional difference is less than a preset threshold, then the process returns to block 516. On the other hand, if the proportional difference is not less than the preset threshold, then, at block 520, the peak shaving component is re-activated. Generally, once activated, the peak shaving component is only "stopped" when active drilling stops (e.g. to attach a new stand to the drill string) or when the component is deactivated.

Generally, during the operation of peak shaving controller 224 described above in connection with FIG. 5, an ROP setpoint limit may be controlled in tandem by DOC controller 226. According to some embodiments, however, DOC controller 226 may operate independently of peak shaving controller 224 (as will now be described in FIG. 6). For example, peak shaving controller 224 may be switched off, and DOC controller 226 may be switched on, or vice versa.

Figure 6:
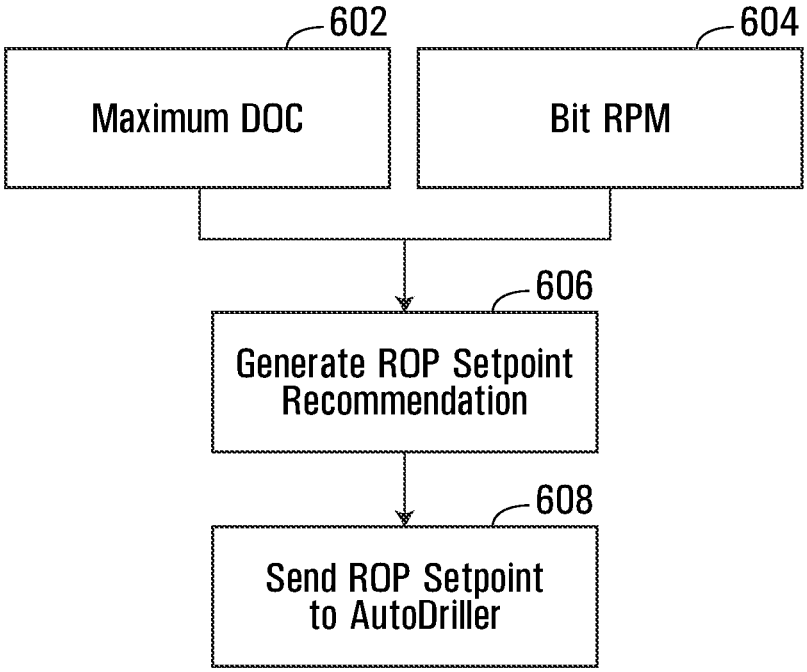
FIG. 6 depicts a flow diagram of a first method of controlling a drilling operation by adjusting a rate of penetration setpoint based on a maximum depth of cut value, according to an embodiment of the disclosure.

Turning now to FIG. 6, there is shown a flow diagram of a method of controlling a drilling operation by adjusting a rate of penetration setpoint based on a maximum depth of cut value, according to an embodiment of the disclosure.

According to the operations of DOC controller 226, a user may set a maximum depth of cut (DOC) that should not be exceeded, in order to better preserve the life of the drill bit. Based on the maximum DOC set by the user, the corresponding maximum ROP that should not be exceeded is calculated and used as the ROP setpoint.

At block 602, a maximum DOC value is received at DOC controller 226. For example, the maximum DOC value may be input by a user.

At block 604, DOC controller 226 determines a current RPM value of the drill bit. For example, the current RPM value may be determined based on a current reading from an RPM sensor.

At block 606, based on the current RPM value and the maximum DOC value, DOC controller 226 generates an ROP setpoint recommendation by multiplying the current RPM value with the maximum DOC value. When multiplying the current RPM value with the maximum DOC value, an additional multiplication factor may be used depending on the units of the RPM value and the DOC value.

According to some embodiments, the maximum DOC value that is used to determine the ROP setpoint recommendation may be variable as a function of depth. For example, a user may set different maximum DOC values for different drill depths. As drilling progresses, the maximum DOC value, and accordingly the ROP setpoint recommendation, may correspondingly change. A lower maximum DOC setting is typically used for formations that are more ratty/variable.

At block 608, the ROP setpoint recommendation is passed to automated drilling unit 208 which proceeds to control the drilling operation according to the ROP setpoint recommendation.

The process illustrated in FIG. 6 may be repeated, for example, every 1 second, or according to any other preset frequency. Therefore, the ROP setpoint recommendation may be calculated every 1 second (or according to any other preset frequency), and may change depending on whether a new bit RPM reading is received or if a new maximum DOC value has been input by the user.

Figure 7:
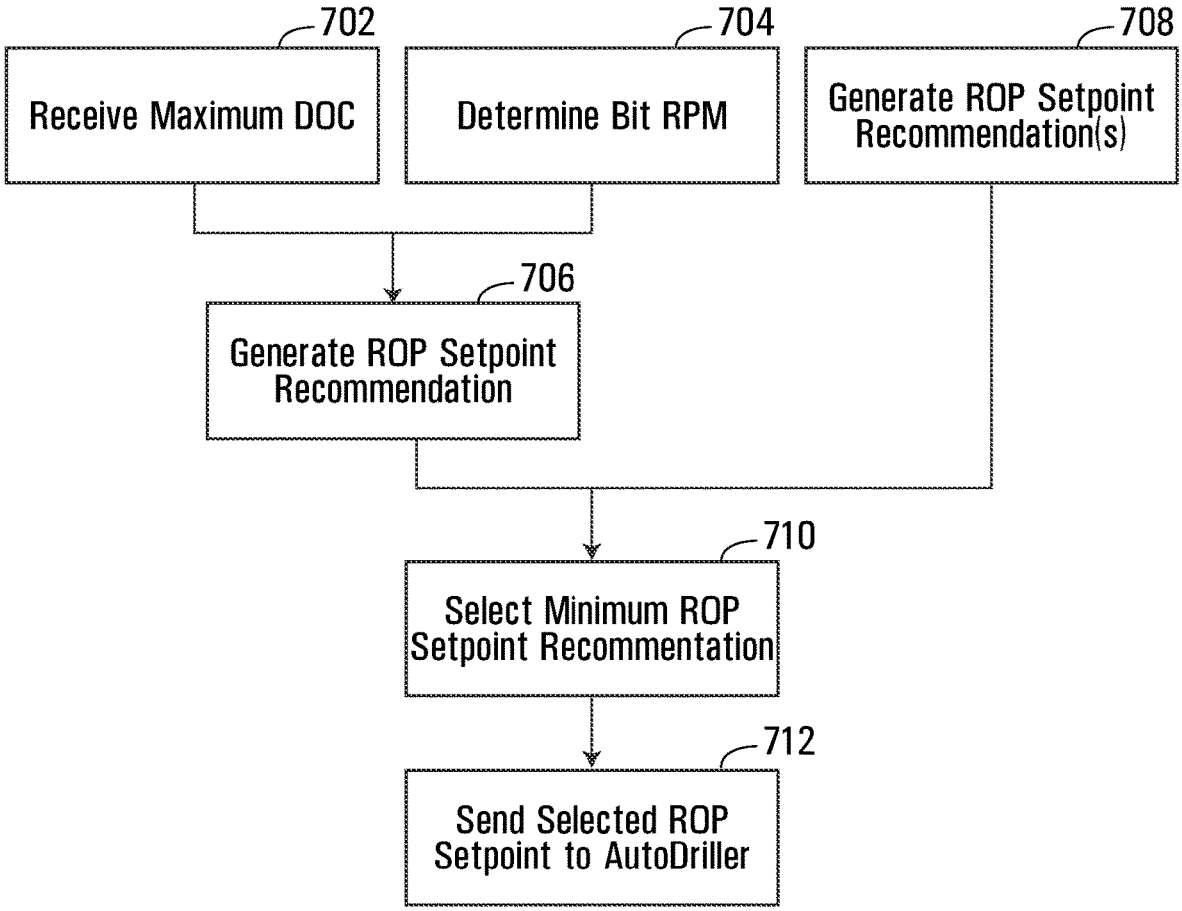
FIG. 7 depicts a flow diagram of a second method of controlling a drilling operation by adjusting a rate of penetration setpoint based on a maximum depth of cut value, according to an embodiment of the disclosure.

Turning to FIG. 7, there is shown another flow diagram of a method of controlling a drilling operation by adjusting a rate of penetration setpoint based on a maximum depth of cut value, according to an embodiment of the disclosure. According to this embodiment, DOC controller 226 operates to generate ROP setpoint recommendations, while in tandem other ROP setpoint recommendations are generated by one or more other components of optimization and control software 234, including for example peak shaving controller 224.

In particular, at block 702, a maximum DOC value is received at DOC controller 226. For example, the maximum DOC value may be input by a user.

At block 704, DOC controller 226 determines a current RPM value of the drill bit. For example, the current RPM value may be determined based on a current reading from an RPM sensor.

At block 706, based on the current RPM value and the maximum DOC value, DOC controller 226 generates an ROP setpoint recommendation by multiplying the current RPM value with the maximum DOC value. When multiplying the current RPM value with the maximum DOC value, an additional multiplication factor may be used depending on the units of the RPM value and the DOC value.

In parallel, at block 708, one or more other ROP setpoint recommendations are generated by one or more other components operating in tandem with automated drilling unit 208. One such component may be peak shaving controller 224.

At block 710, optimization and control software 234 receives each recommended ROP setpoint, and selects the minimum ROP setpoint recommendation it receives.

At block 712, the selected ROP setpoint is passed to automated drilling unit 208 which proceeds to control the drilling operation according to the selected minimum ROP setpoint.

Figure 8:
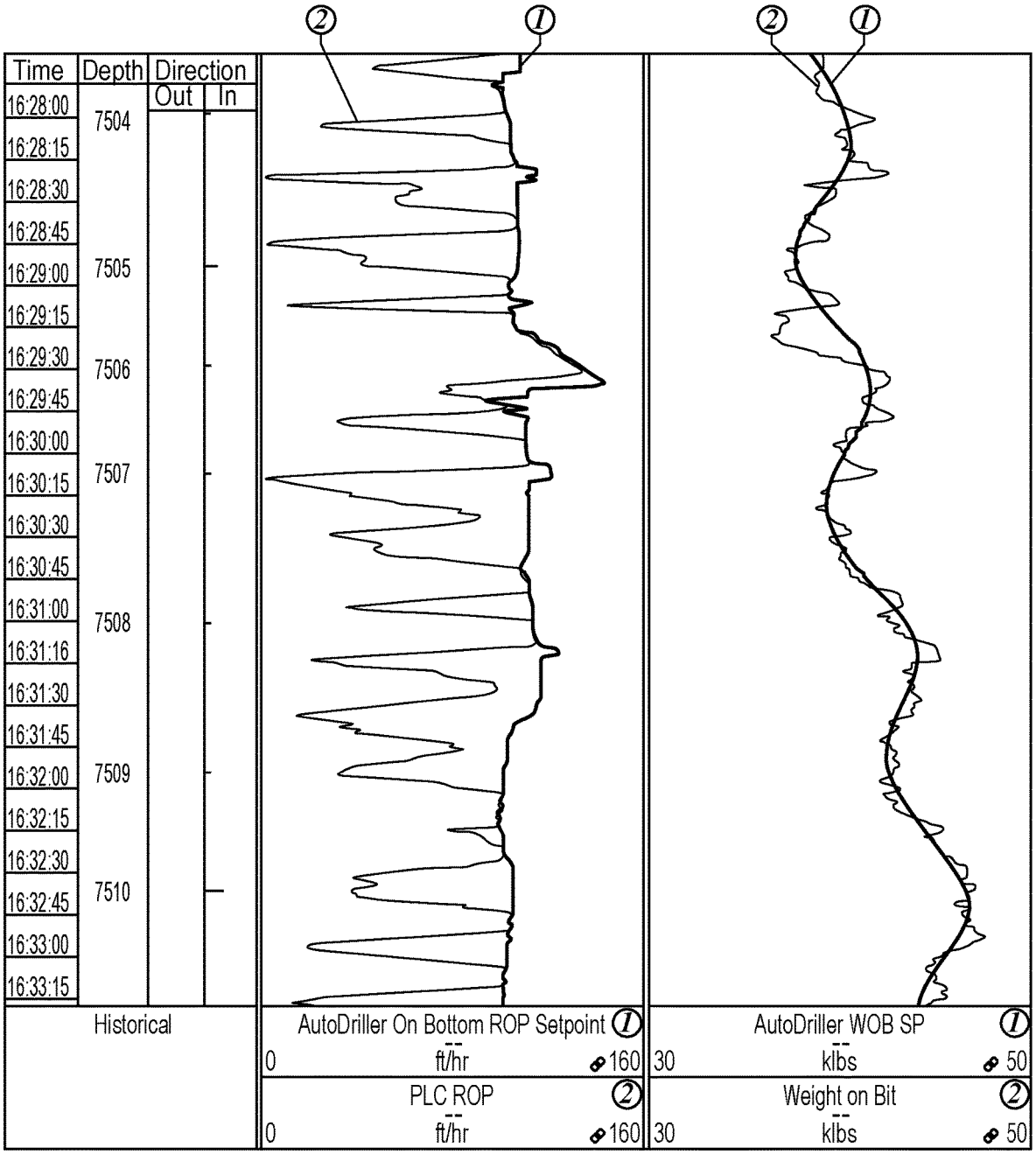
FIG. 8 is a first plot showing variations in drilling parameters, including weight on bit, rate of penetration, and their respective setpoints, according to an embodiment of the disclosure.
Figure 9:
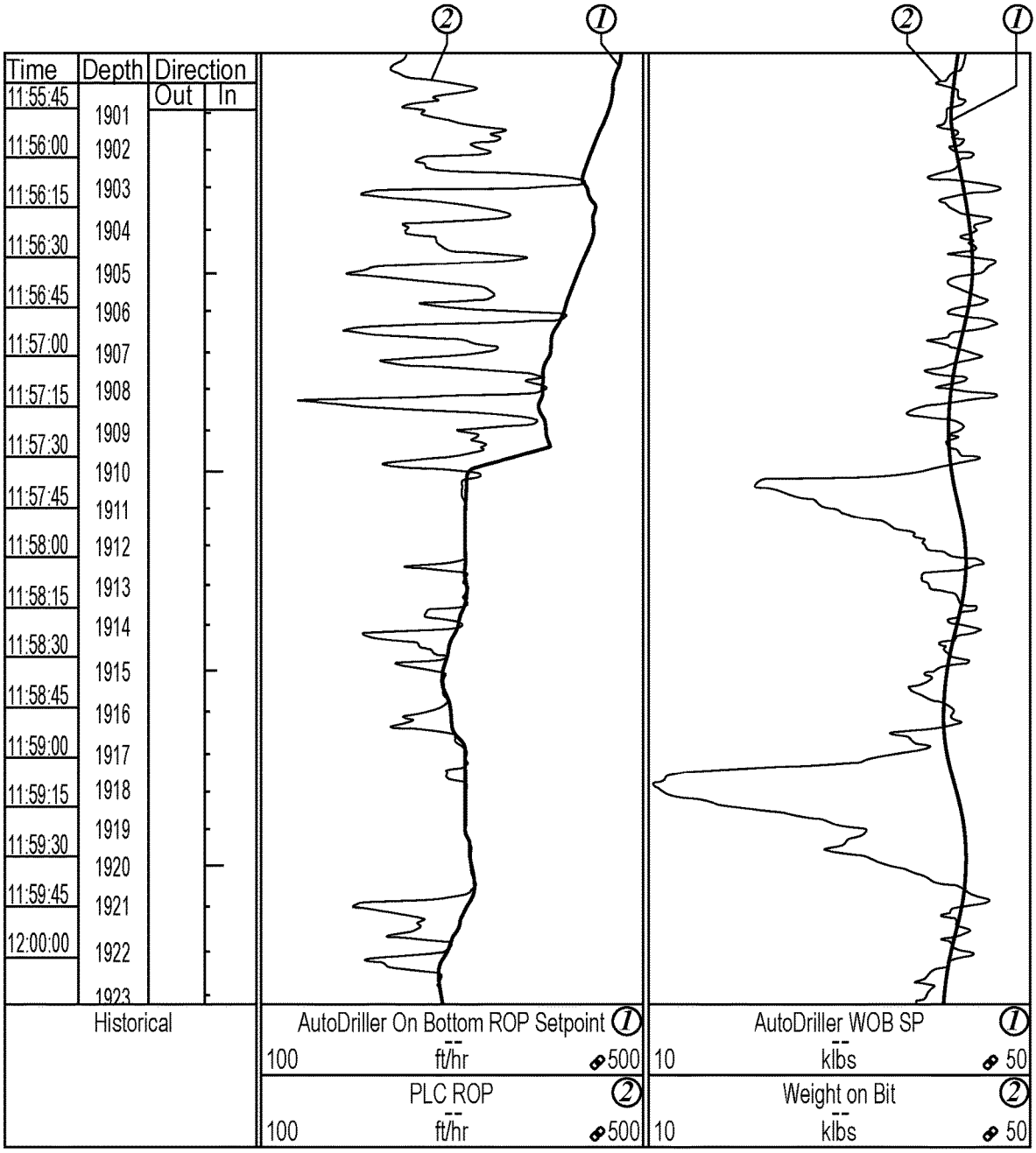
FIG. 9 is a second plot showing variations in drilling parameters, including weight on bit, rate of penetration, and their respective setpoints, according to an embodiment of the disclosure.

Turning to FIG. 8, there is shown a plot showing variations in drilling parameters, including weight on bit and rate of penetration, and their respective setpoints, according to an embodiment of the disclosure. As can be seen, the peak shaving operation is activated in response to excessive variability in the ROP readings having been detected. At about 7,506 feet, the measured WOB falls below its setpoint which triggers de-activation of the peak shaving operation and a ramping of the ROP setpoint before resuming peak shaving, as described above Turning to FIG. 9, there is shown a plot showing variations in drilling parameters, including weight on bit and rate of penetration, and their respective setpoints, according to an embodiment of the disclosure. As can be seen, the peak shaving operation is activated at about 1,910 feet at an aggressive setting (e.g. with a percentile that results in greater curbing of the ROP setpoint). This results in a significant lowering of the ROP setpoint, which may contribute to a significant drop in the WOB. Had the peak shaving operation been applied with a lower "aggressiveness", this likely would have kept the system closer to its normal behavior. As can be seen, there is a trade-off between peak shaving that is applied strongly or aggressively, and resulting drops in the WOB. In FIG. 9, the component configured to de-activate peak shaving and raise the ROP setpoint to counteract the drop in WOB was not functional (whereas in FIG. 8 it was).

While particular embodiments have been described in the foregoing, it is to be understood that other embodiments are possible and are intended to be included herein. It will be clear to any person skilled in the art that modifications of and adjustments to the foregoing embodiments, not shown, are possible.

As an example, in the depicted embodiments the drawworks 114 is used to raise and lower the drill string 118. In different embodiments (not depicted), a different height control apparatus for raising or lowering the drill string 118 may be used. For example, hydraulics may be used for raising and lowering the drill string 118. In embodiments in which hydraulics are used, the traveling block 108 may be omitted and consequently the processor 212 does not use the height of the block 108 as a proxy for drill string height, as it does in the depicted embodiments. In those embodiments, the processor 212 may use output from a different type of height sensor to determine drill string position and ROP. For example, the motion of the traveling block 108 may be translated into rotary motion and rotary motion encoder may then be used to digitize readings of that motion. This may be done using a roller that runs along a rail or, if crown sheaves are present, the encoder may be installed on the sheaves' axel. Various gears may also be present as desired. As additional examples, laser based motion measurements may be taken, a machine vision based measurement system may be used, or both.

While a single processor 212 is depicted in FIG. 2A, in different embodiments (not depicted) the processor 212 may comprise multiple processors, one or more microprocessors, or a combination thereof. Similarly, in different embodiments (not depicted) the single memory 214 may comprise multiple memories. Any one or more of those memories may comprise, for example, mass memory storage, ROM, RAM, hard disk drives, optical disk drives (including CD and DVD drives), magnetic disk drives, magnetic tape drives (including LTO, DLT, DAT and DCC), flash drives, removable memory chips such as EPROM or PROM, or similar storage media as known in the art.

In different embodiments (not depicted), the computer 210 may also comprise other components for allowing computer programs or other instructions to be loaded. Those components may comprise, for example, a communications interface that allows software and data to be transferred between the computer 210 and external systems and networks. Examples of the communications interface comprise a modem, a network interface such as an Ethernet card, a wireless communication interface, or a serial or parallel communications port. Software and data transferred via the communications interface are in the form of signals which can be electronic, acoustic, electromagnetic, optical, or other signals capable of being received by the communications interface. The computer 210 may comprise multiple interfaces.

In certain embodiments (not depicted), input to and output from the computer 210 is administered by an input/output (I/O) interface. In these embodiments the computer 210 may further comprise a display and input devices in the form, for example, of a keyboard and mouse. The I/O interface administers control of the display, keyboard, and mouse. In certain additional embodiments (not depicted), the computer 210 also comprises a graphical processing unit. The graphical processing unit may also be used for computational purposes as an adjunct to, or instead of, the processor 210.

In all embodiments, the various components of the computer 210 may be communicatively coupled to one another either directly or indirectly by shared coupling to one or more suitable buses.

Directional terms such as "top", "bottom", "up", "down", "front", and "back" are used in this disclosure for the purpose of providing relative reference only, and are not intended to suggest any limitations on how any article is to be positioned during use, or to be mounted in an assembly or relative to an environment. The term "couple" and similar terms, and variants of them, as used in this disclosure are intended to include indirect and direct coupling unless otherwise indicated. For example, if a first component is communicatively coupled to a second component, those components may communicate directly with each other or indirectly via another component. Additionally, the singular forms "a", "an", and "the" as used in this disclosure are intended to include the plural forms as well, unless the context clearly indicates otherwise.

The word "approximately" as used in this description in conjunction with a number or metric means within 5% of that number or metric.

Use of language such as "at least one of X, Y, and Z," "at least one of X, Y, or Z," "at least one or more of X, Y, and Z," "at least one or more of X, Y, and/or Z," or "at least one of X, Y, and/or Z," is intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

It is contemplated that any feature of any aspect or embodiment discussed in this specification can be implemented or combined with any feature of any other aspect or embodiment discussed in this specification, except where those features have been explicitly described as mutually exclusive alternatives.

The invention claimed is:

1. A method of controlling a drilling operation, comprising:

receiving rate-of-penetration (ROP) data, wherein the ROP data is indicative of a ROP of a drill bit being operated during the drilling operation;

determining, based on the ROP data, that an ROP variability condition has been met, including:

determining a variability of the ROP data;

comparing the variability to a threshold; and determining, based on the comparison, that the variability has exceeded the threshold;

based on the determination that the ROP variability condition has been met, activating a peak-shaving operation comprising adjusting, based on the ROP data, an ROP setpoint; and controlling the drilling operation according to the adjusted ROP setpoint.

2. The method of claim 1, wherein determining that the variability of the ROP has exceeded the threshold comprises:

windowing the ROP data by applying a temporal window to the ROP data; and determining, based on the windowed ROP data, that the variability of the ROP during the temporal window has exceeded the threshold.

3. The method of claim 1, wherein determining that the variability of the ROP has exceeded the threshold comprises:

determining, based on the ROP data, a coefficient of variation of the ROP, wherein the coefficient of variation is a standard deviation of ROP readings comprised in the ROP data divided by an average of the ROP readings; and determining that the coefficient of variation has exceeded the threshold.

4. The method of claim 1, wherein adjusting the ROP setpoint comprises:

windowing the ROP data by applying a temporal window to the ROP data; and adjusting the ROP setpoint based on the windowed ROP data.

5. The method of claim 1, wherein adjusting the ROP setpoint comprises:

determining, based on the ROP data, a percentile of the ROP data; and adjusting the ROP setpoint by a sum of the percentile and an offset value.

6. The method of claim 1, further comprising:

receiving weight-on-bit (WOB) data, wherein the WOB data is indicative of a weight acting on the drill bit during the drilling operation;

determining, based on the WOB data, that a preset condition has been met; and based on the determination that the preset condition has been met:

deactivating the peak-shaving operation; and increasing the ROP setpoint.

7. The method of claim 6, wherein determining that the preset condition has been met comprises:

determining, based the WOB data, a proportional difference between the WOB setpoint and the WOB;

determining that the proportional difference between the WOB setpoint and the WOB is greater than a first threshold;

determining, based on the ROP data, a proportional difference between the ROP setpoint and the ROP;

determining that the proportional difference between the ROP setpoint and the ROP is less than a second threshold, wherein the first threshold is greater than the second threshold; and based on the determination that the proportional difference between the WOB setpoint and the WOB is greater than the first threshold, and based on the determination that the proportional difference between the ROP setpoint and the ROP is less than the second threshold, determining that the preset condition has been met.

8. The method of claim 6, wherein increasing the ROP setpoint comprises linearly increasing the ROP setpoint.

9. The method of claim 6, wherein increasing the ROP setpoint comprises:

determining, based on the ROP data, a proximity of the ROP to the ROP setpoint; and increasing the ROP setpoint until the proximity of the ROP to the ROP setpoint is less than a proximity threshold.

10. The method of claim 9, further comprising:

once the proximity of the ROP to the ROP setpoint is less than the proximity threshold, re-activating the peak-shaving operation.

11. The method of claim 1, wherein:

the method further comprises monitoring a depth of the drill bit; and the peak-shaving operation further comprises adjusting the ROP setpoint based on the monitored depth.

12. The method of claim 1, further comprising:

determining a maximum ROP setpoint; and during the drilling operation, preventing the ROP setpoint from being increased above the maximum ROP setpoint.

13. The method of claim 12, further comprising:

determining that the ROP setpoint is greater than the maximum ROP setpoint; and before preventing the ROP setpoint from being increased above the maximum ROP setpoint, setting the ROP setpoint equal to the maximum ROP setpoint.

14. The method of claim 12, wherein determining the maximum ROP setpoint comprises:

receiving a maximum depth of cut (DOC) value; and determining, based on the maximum DOC value, the maximum ROP setpoint.

15. The method of claim 14, wherein determining the maximum ROP setpoint comprises:

determining a revolutions-per-minute (RPM) value, wherein the RPM value is indicative of a rotational speed of the drill bit;

multiplying the RPM value by the maximum DOC value; and determining the maximum ROP setpoint based on the multiplication.

16. The method of claim 14, wherein:

the method further comprises monitoring a depth of the drill bit; and receiving the maximum DOC value comprises receiving the maximum DOC value based on the monitored depth.

17. A method of controlling a drilling operation, comprising:

receiving a maximum depth of cut (DOC) value;

generating, using a DOC controller and based on the maximum DOC value, a first recommended rate-of-penetration (ROP) setpoint;

generating, using at least one additional controller different from the DOC controller, one or more additional recommended ROP setpoints;

selecting, from among the first recommended ROP setpoint and the one or more additional recommended ROP setpoints, one of the recommended ROP setpoints; and controlling the drilling operation according to the selected recommended ROP setpoint.

18. The method of claim 17, wherein generating the first recommended ROP setpoint comprises:

receiving a revolutions-per-minute (RPM) value, wherein the RPM value is indicative of a rotational speed of a drill bit being operated during the drilling operation;

multiplying the RPM value by the maximum DOC value; and determining the first recommended ROP setpoint based on the multiplication.

19. The method of claim 17, wherein selecting one of the recommended ROP setpoints comprises selecting, from among the recommended ROP setpoints, the minimum ROP setpoint recommendation.

20. The method of claim 17, wherein generating the one or more additional ROP setpoint recommendations comprises generating an additional ROP setpoint recommendation from a peak shaving operation comprising:

receiving rate-of-penetration (ROP) data, wherein the ROP data is indicative of a ROP of a drill bit being operated during the drilling operation;

determining, based on the ROP data, that an ROP variability condition has been met, including determining that a variability of the ROP has exceeded a threshold; and based on the determination that the ROP variability condition has been met, generating, based on the ROP data, the additional ROP setpoint recommendation.

21. The method of claim 17, wherein:

the method further comprises monitoring a depth of a drill bit being operated during the drilling operation; and receiving the maximum DOC value comprises receiving the maximum DOC value based on the monitored depth.

22. The method of claim 17, wherein the additional controller comprises a peak shaving controller.

23. A system for controlling a drilling operation, the system comprising:

a height control apparatus configured to adjust a height of a drill string comprising a drill bit used during the drilling operation;

a rotational drive unit comprising a rotational drive unit controller configured to control rotation of the drill bit; and a drilling controller communicatively coupled to the height control apparatus and the rotational drive unit controller, and being configured to perform a method comprising:

receiving rate-of-penetration (ROP) data, wherein the ROP data is indicative of a ROP of the drill bit during the drilling operation;

determining, based on the ROP data, whether an ROP variability condition has been met, including:

determining a variability of the ROP data;

comparing the variability to a threshold; and determining, based on the comparison, whether the variability has exceeded the threshold;

if the ROP variability condition has been met, activating a peak-shaving operation comprising adjusting, based on the ROP data, an ROP setpoint; and controlling the drilling operation according to the adjusted ROP setpoint.

24. The system of claim 23, wherein the height control apparatus is one or more selected from: a drawworks; and hydraulics.

25. A non-transitory computer-readable medium having stored thereon program code executable by a processor and configured, when executed, to cause the processor to perform a method of controlling a drilling operation, comprising:

receiving rate-of-penetration (ROP) data, wherein the ROP data is indicative of a ROP of a drill bit being operated during a drilling operation;

determining, based on the ROP data, whether an ROP variability condition has been met, including:

determining a variability of the ROP data;

comparing the variability to a threshold; and determining, based on the comparison, whether the variability has exceeded the threshold;

if the ROP variability condition has been met, activating a peak-shaving operation comprising adjusting, based on the ROP data, an ROP setpoint; and controlling the drilling operation according to the adjusted ROP setpoint.

26. A system for controlling a drilling operation, the system comprising:

a height control apparatus configured to adjust a height of a drill string comprising a drill bit used during the drilling operation;

a rotational drive unit comprising a rotational drive unit controller configured to control rotation of the drill bit; and a drilling controller communicatively coupled to the height control apparatus and the rotational drive unit controller, and being configured to perform a method comprising:

receiving a maximum depth of cut (DOC) value;

generating, using a DOC controller and based on the maximum DOC value, a first recommended rate-of-penetration (ROP) setpoint;

generating, using at least one additional controller different from the DOC controller, one or more additional recommended ROP setpoints;

selecting, from among the first recommended ROP setpoint and the one or more additional recommended ROP setpoints, one of the recommended ROP setpoints; and controlling the drilling operation according to the selected recommended ROP setpoint.

27. The system of claim 26, wherein the height control apparatus is one or more selected from: a drawworks; and hydraulics.

28. A non-transitory computer-readable medium having stored thereon program code executable by a processor and configured, when executed, to cause the processor to perform a method of controlling a drilling operation, comprising:

receiving a maximum depth of cut (DOC) value;

generating, using a DOC controller and based on the maximum DOC value, a first recommended rate-of-penetration (ROP) setpoint;

generating, using at least one additional controller different from the DOC controller, one or more additional recommended ROP setpoints;

selecting, from among the first recommended ROP setpoint and the one or more additional recommended ROP setpoints, one of the recommended ROP setpoints; and controlling the drilling operation according to the selected recommended ROP setpoint.

* * * * *